US008602406B2

(12) United States Patent
Caron

(10) Patent No.: US 8,602,406 B2
(45) Date of Patent: Dec. 10, 2013

(54) SIGNATURE TRANSPORT DEVICE WITH ROTARY ARM AND METHOD

(75) Inventor: Glen Roger Caron, Deerfield, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 13/110,666

(22) Filed: May 18, 2011

(65) Prior Publication Data

US 2012/0119429 A1 May 17, 2012

Related U.S. Application Data

(60) Provisional application No. 61/349,644, filed on May 28, 2010.

(51) Int. Cl.
*B42B 2/00* (2006.01)

(52) U.S. Cl.
USPC ..... 271/3.18; 270/52.3

(58) Field of Classification Search
USPC ..... 271/3.18; 270/52.14, 52.16, 52.26, 270/52.27, 52.29, 52.3, 52.23, 52.25
See application file for complete search history.

(56) References Cited

U.S. PATENT DOCUMENTS

| | | | | |
|---|---|---|---|---|
| 4,555,101 | A * | 11/1985 | Stobb | 271/12 |
| 5,013,019 | A * | 5/1991 | Samuels | 270/1.02 |
| 5,052,667 | A * | 10/1991 | Hansch | 270/52.3 |
| 5,137,409 | A * | 8/1992 | Honegger | 412/8 |
| 5,248,135 | A * | 9/1993 | Leu | 270/52.27 |
| 5,324,014 | A * | 6/1994 | Honegger et al. | 270/52.3 |
| 6,375,179 | B1 | 4/2002 | Boss et al. | |
| 7,192,027 | B2 | 3/2007 | Schlough | |
| 7,530,564 | B2 | 5/2009 | Guaraldi et al. | |
| 7,631,914 | B2 | 12/2009 | Curley | |
| 2008/0007075 | A1 | 1/2008 | Curley | |
| 2009/0309289 | A1 | 12/2009 | Geisseler et al. | |

* cited by examiner

*Primary Examiner* — Jeremy R Severson
(74) *Attorney, Agent, or Firm* — Davidson, Davidson & Kappel, LLC

(57) ABSTRACT

A signature transport device is provided. The signature transport device includes a first conveyor moving a stream of folded signatures in a first direction, a rotary arm having a gripper, the gripper gripping a folded signature from the stream by a fold, the rotary arm moving the folded signature in a second direction, a toothed drum engaging a portion of the folded signature, the rotary arm rotating past the toothed drum to open the folded signature and a second conveyor receiving the opened signature from the gripper as the rotary arm continues to rotate. A method is also provided.

17 Claims, 7 Drawing Sheets

SIGNATURE TRANSPORT DEVICE WITH ROTARY ARM AND METHOD

BACKGROUND

The present invention relates generally to post press printing equipment and more particularly to signature feeders and saddle conveyors.

U.S. Pat. No. 6,375,179 purportedly discloses a device for opening and depositing a folded signature onto a moving conveyor, particularly a collecting chain. The device includes two opening rollers with axes that extend essentially parallel to the conveying direction of the conveyor and respectively open one signature and deposit it with the opened side first in a downwardly direction onto the conveyor, wherein the signatures are pre-accelerated in the conveying direction of the conveyor.

U.S. Pat. No. 7,192,027 discloses a signature transport device which includes a first conveyor moving a plurality of folded signatures in a first direction and a second conveyor including a first blade having a first edge for lifting a first signature of the plurality of signatures from the first conveyor.

U.S. Pat. Nos. 7,530,564 and 7,631,914 and U.S. Publication No. 2008/0007075 A1 disclose a gripping device for gripping printed products. The gripping device includes a gripper having a first gripper arm having a first gripper pad on one end rotatable about a first pivot and a second gripper arm having a second gripper pad on one end rotatable about a second pivot.

U.S. Publication No. 2009/0309289 purportedly discloses an apparatus for withdrawing flat products from a stack and transporting the printed products. The apparatus includes a transporting device, a separating device and a rotating conveyor. The rotating conveyor includes at least one gripper with a gripper plane to grip a separated printed product in the gripper plane and supply the separated printed product to the transporting device.

FIG. 1 shows a conventional hopper apparatus 10. Hopper 10 includes a stack 12 of sheets or signatures which may be folded printed products. Each printed product is transported from a bottom of stack 12 to a gripper drum 20. As shown in FIG. 1, signature 14 is held onto gripper drum 20 via a gripper 22. Gripper drum 20 may include a plurality of grippers 22. As shown in FIG. 1, gripper drum 20 includes three grippers. A suction element 16 may aid the removal of the bottommost signature from stack 12. A spine of the folded signature is pulled down by suction element 16 then gripped by gripper 22 so the spine of signature 14 is tucked into gripper drum 20. Gripper drum 20 rotates in a counterclockwise direction until signatures 14 reaches a register stop 24. Register stop 24 provides a consistent location for lining up a lap in the tail open end of signature 14 for transfer to opening drums 30, 32. Signature 14 is then transported in a different direction via guide 26, with the tail open end of the folded signature now leading. Signature 14 is transported to opening rollers 30, 32, which open signature 14 by each gripping a leg of signature 14. Opening rollers 30, 32 open signatures 14 as the rollers 30, 32 rotate and drop signature 14 onto a saddle conveyor or collecting chain 40.

BRIEF SUMMARY

The operating speed of a conventional hopper and opening drum device may be limited due to the directional and speed changes undergone by the transferred signatures. The signature is pulled from the stack, spine-leading, accelerated around the transfer drum then stopped by the register stop.

The signature is then accelerated again in a different direction with the previous tail end, now leading. These directional and speed changes of the signature may reduce speed and output of the hopper.

In addition, the conventional hopper and opening drum device feeds signatures at a right angle to the saddle conveyor or collecting chain. The signatures are dropped from the opening drums at a height above the saddle conveyor or chain. A lug or register block on the conveyor or chain then contacts the signature and accelerates the signature with the conveyor or chain. This may occur as soon as the signature lands on the chain or conveyor. The impact of the lug/register block on the signature may be severe, especially at high conveyor or chain speeds and may cause damage to the signatures.

The present invention provides a signature transport device including a first conveyor moving folded signatures in a first direction, a rotary arm having a gripper, the gripper gripping a folded signature from the stream by a fold, the rotary arm moving the folded signature in a second direction, a toothed drum engaging a portion of the folded signature, the rotary arm rotating past the toothed drum to open the folded signature and a second conveyor receiving the opened signature from the gripper as the rotary arm continues to rotate.

The present invention further provides a signature transport device including a hopper having a horizontal stack of folded signatures, a first conveyor receiving the folded signatures from the hopper to form a stream of folded signatures moving in a first direction, a rotary arm having a gripper, the gripper gripping a folded signature from the stream by a fold, the folded signature being in a plane of the gripper, the rotary arm rotating about an axis perpendicular to the axis of the gripper plane and moving the folded signature in a second direction while the signature remains in the gripper plane and a second conveyor receiving the signature from the gripper as the rotary arm continues to rotate, a plane of the conveyor receiving the signature overlapping with the gripper plane when the signature is deposited on the conveyor.

The present invention also provides a saddle stitcher.

BRIEF DESCRIPTION OF THE DRAWINGS

FIG. 1 shows a conventional hopper apparatus for moving signatures from a hopper to a saddle conveyor; and A preferred embodiment of the present invention will be elucidated with reference to the drawings, in which:

DETAILED DESCRIPTION OF PREFERRED EMBODIMENTS

Figure 1:
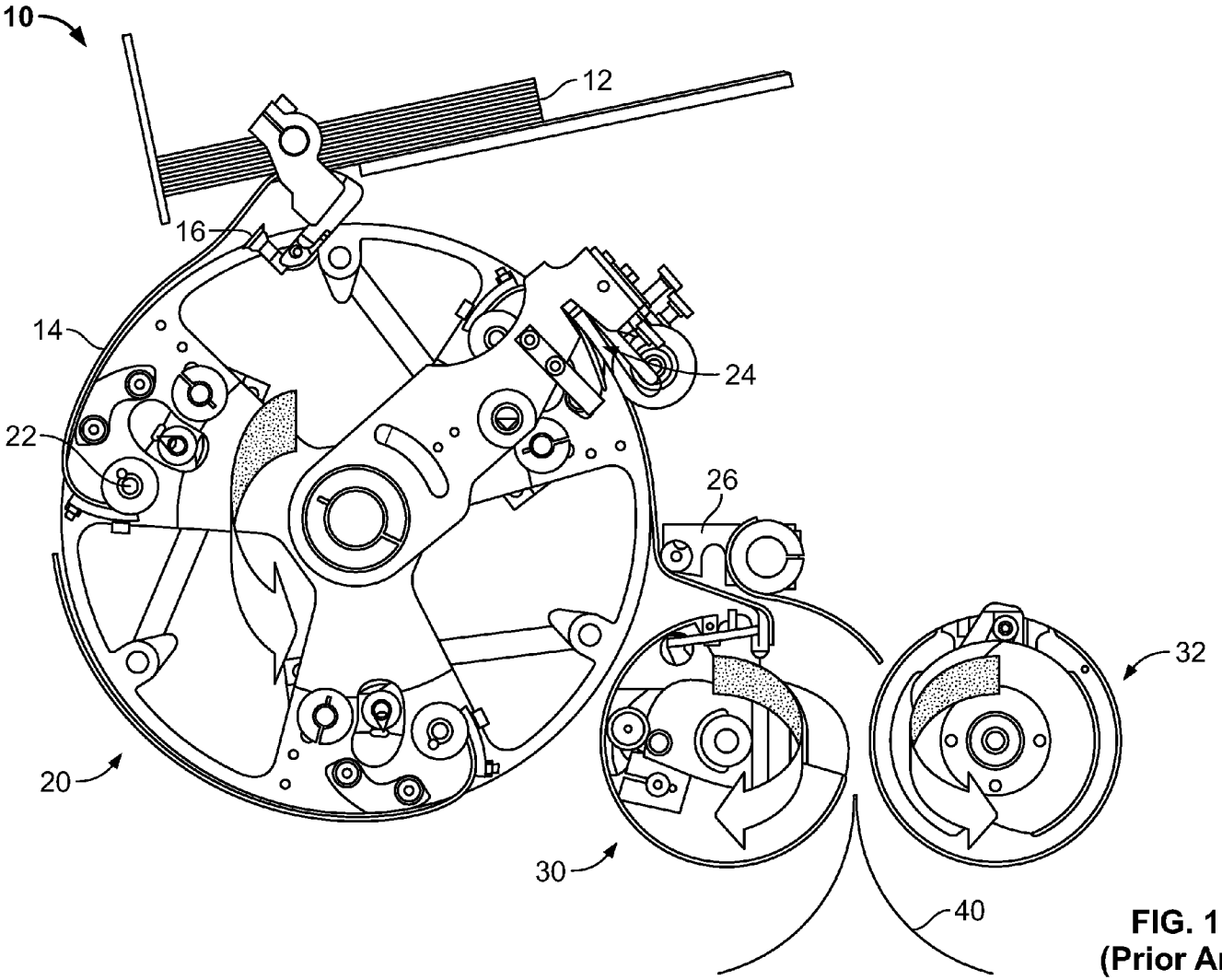
FIG. 1 (Prior Art)
Figure 2:
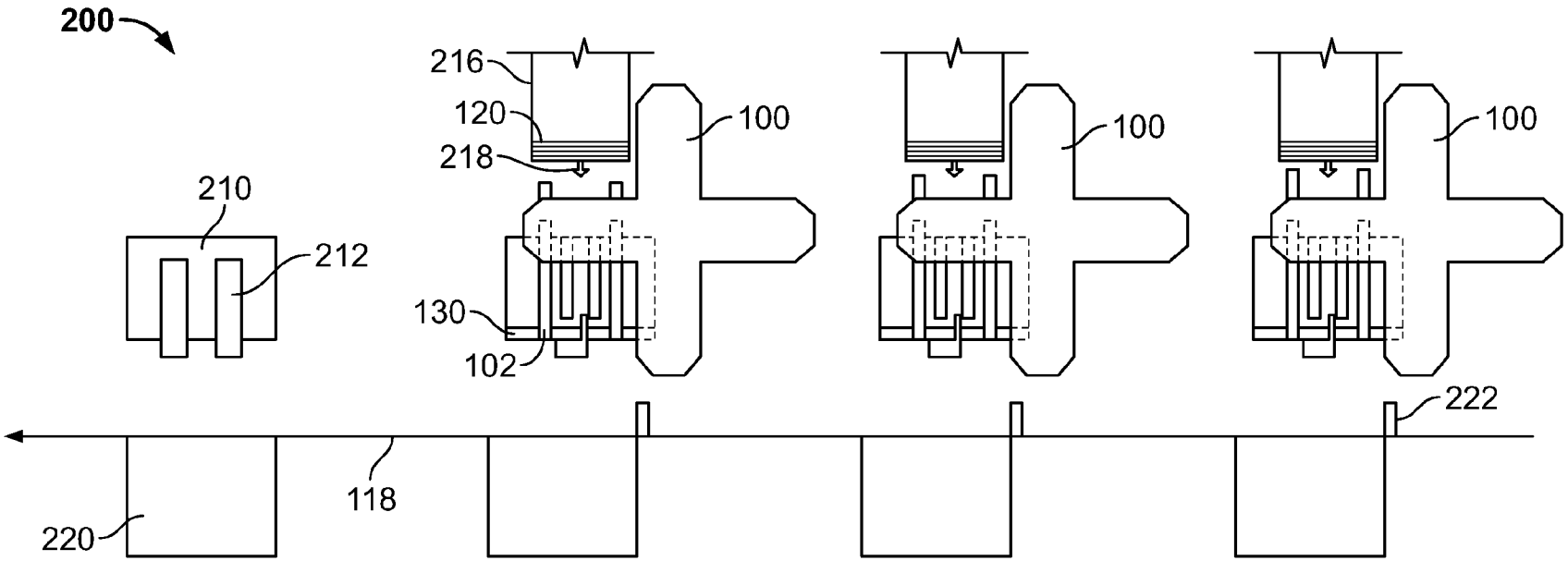
FIG. 2 shows a post press saddle stitcher including a gripper arm transfer device in accordance with an embodiment of the present invention.
Figure 3:
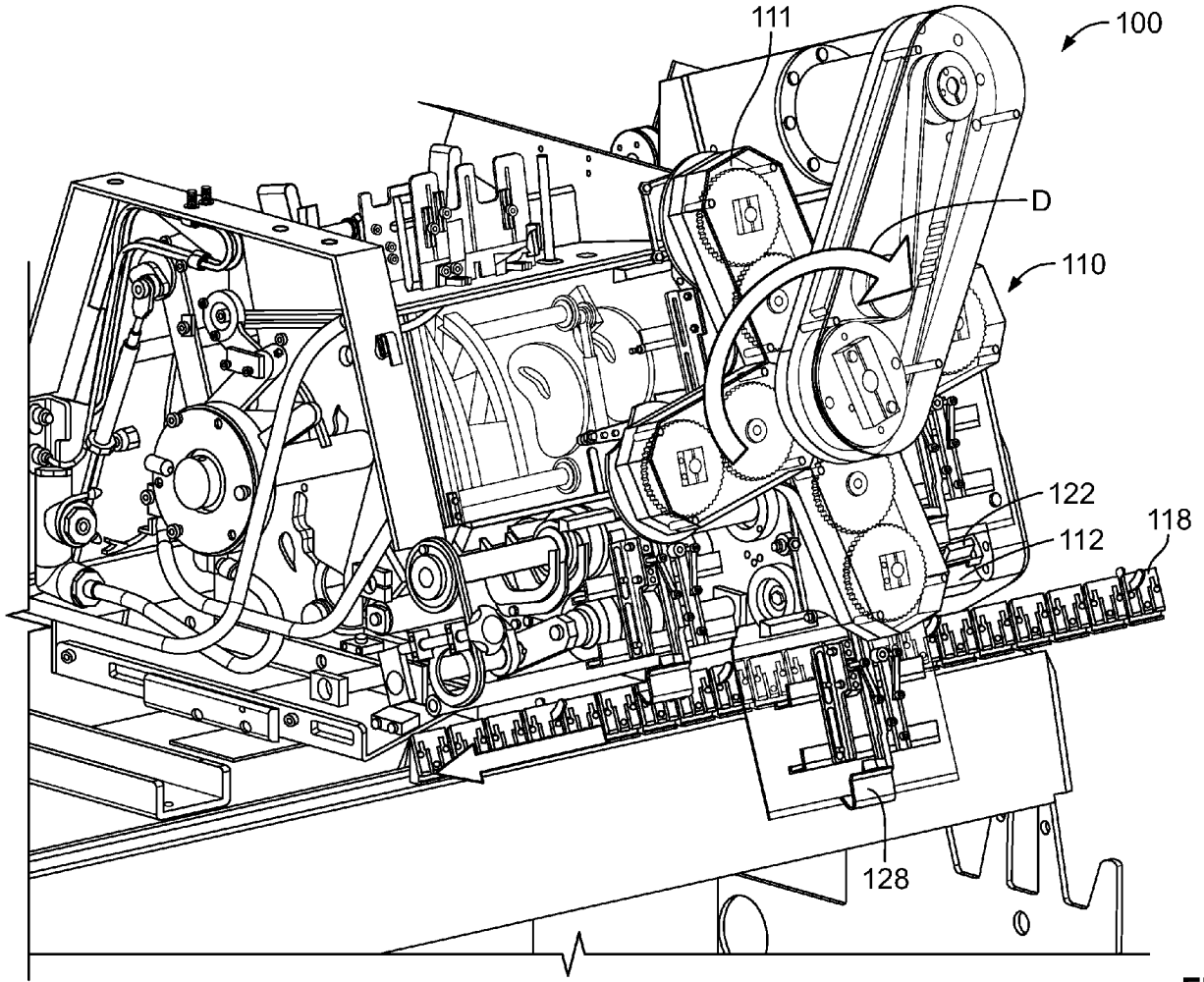
FIGS. 3 to 6 show the gripper arm transfer device depositing signatures onto a chain conveyor according to the present invention.
Figure 4:
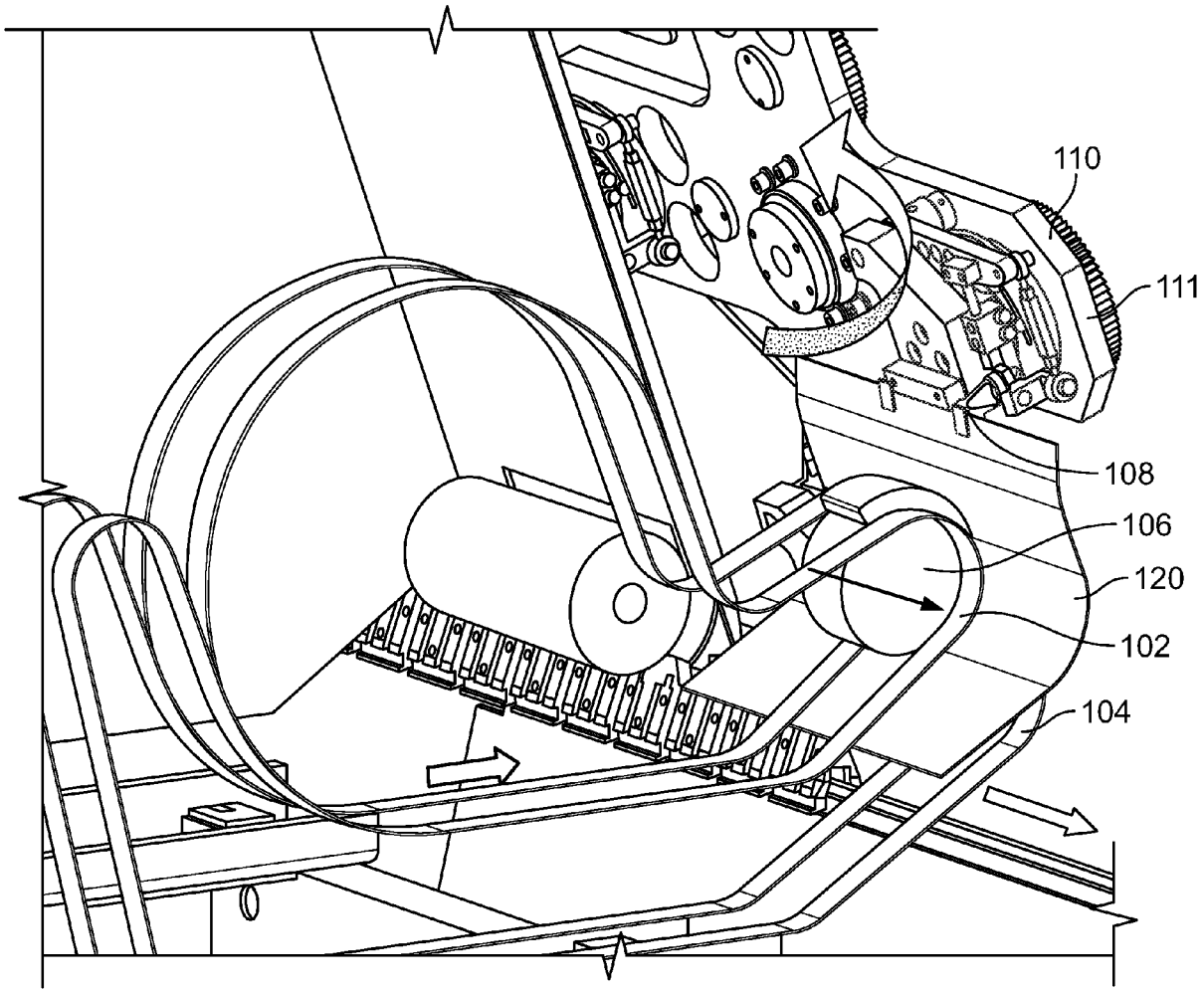
Figure 5:
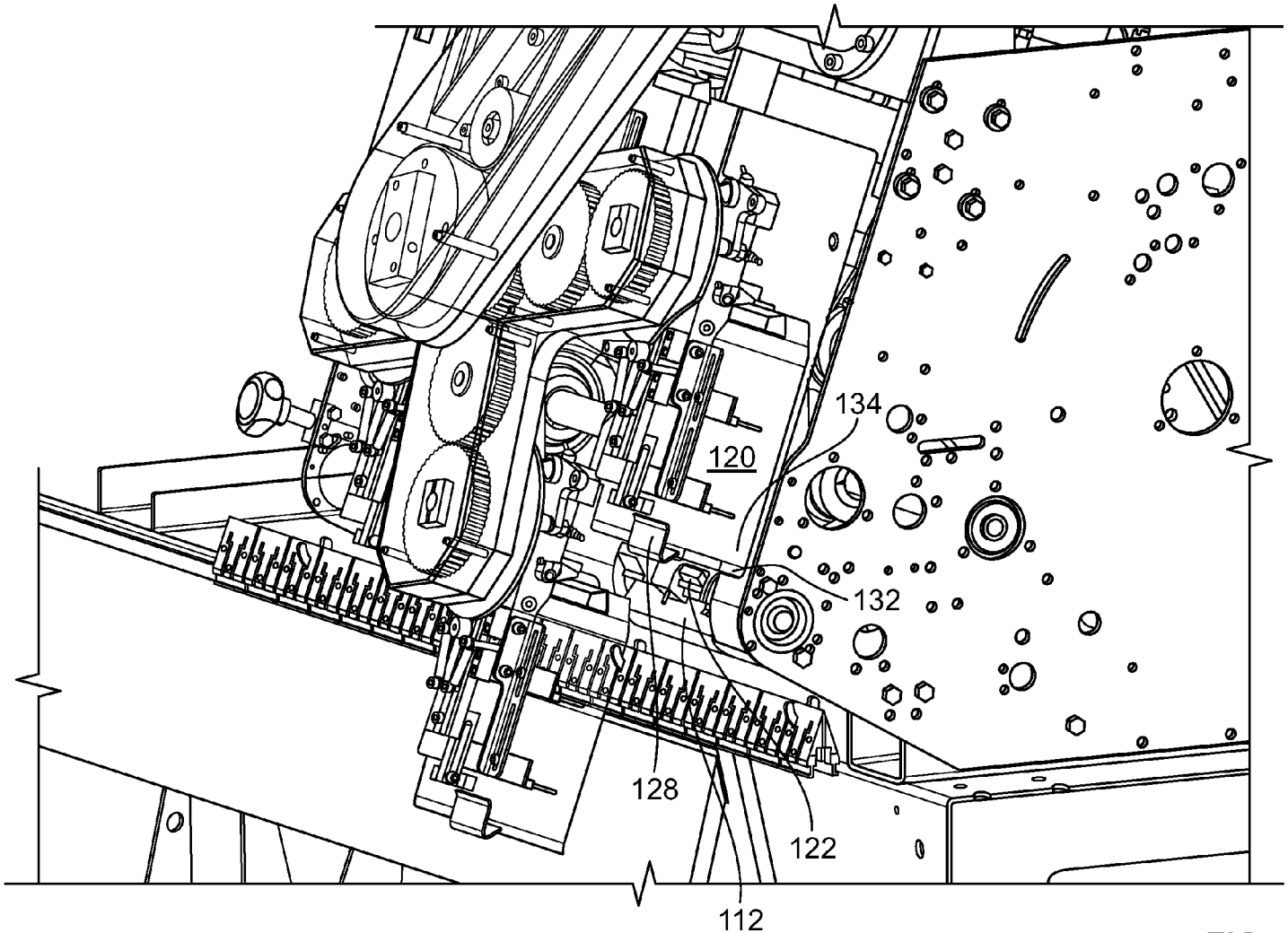
Figure 6:
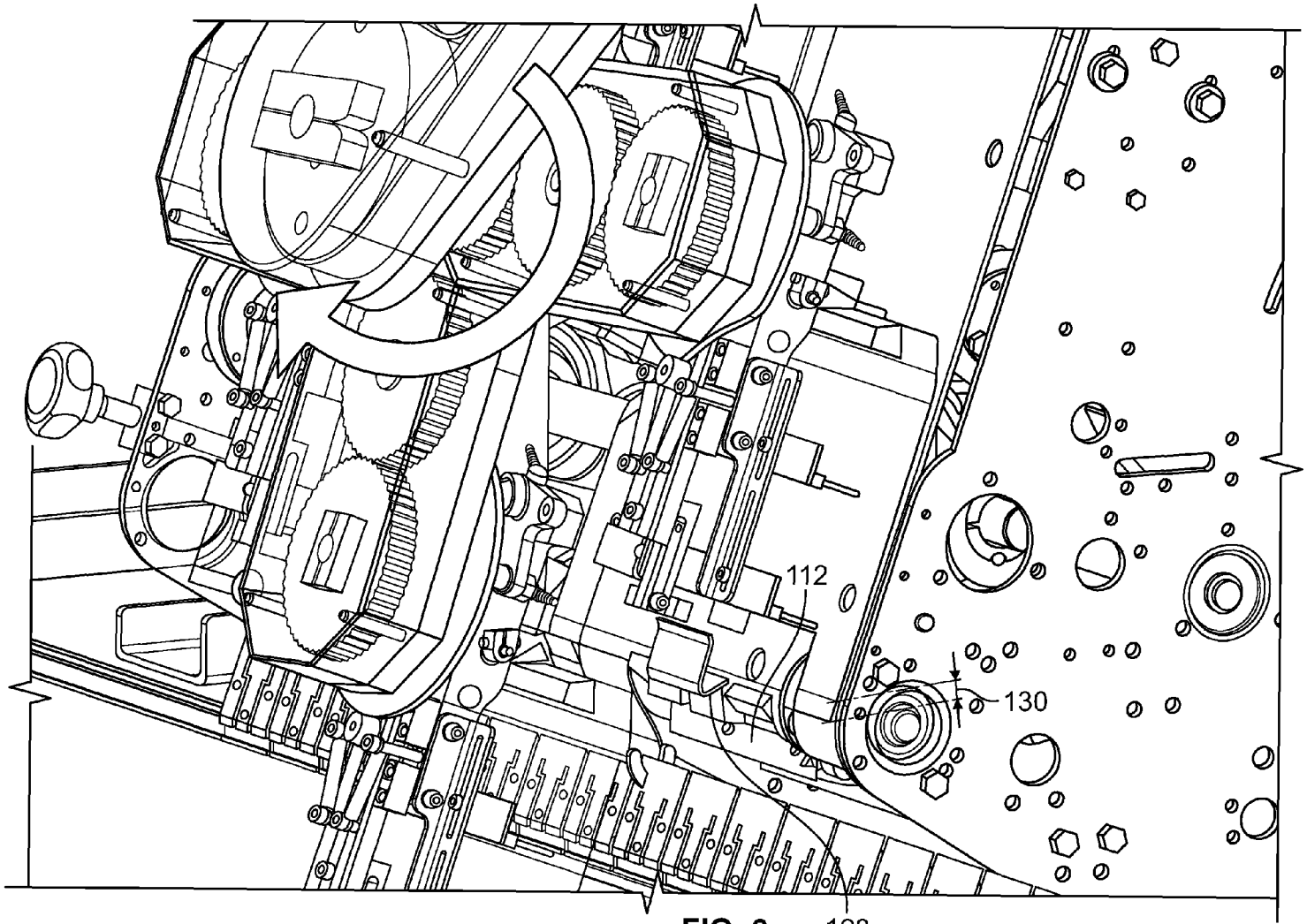

FIG. 2 shows a preferred embodiment of a saddle stitcher 200 including a plurality of gripper arm transfer devices 100 in accordance with the present invention. Saddle stitcher 200 also includes a stitching device 210 which may include a plurality of stitching heads 212 for stitching a book or printed product 220 formed on a conveyor 118. A book may be formed by collecting multiple printed products from transfer devices 100 at a same location on conveyor 118. Conveyor 118 may be for example, a saddle conveyor or inserter chain. A lug or register pin 222 may be used to register each of the printed products and/or resulting book. Hoppers 216 may collect or stack signatures 120 which are transported to gripper arm transfer devices 100 via a first conveyor device, for example, one including tapes 102, 104 (FIG. 4). Signatures 120 may be orientated horizontally in hopper 216 as shown in FIG. 2. A sucker bar 218 or grippers may retrieve signatures 120 from hoppers 216 in a known manner. A drum or other device may be used as well between sucker bar 218 and tapes 102, 104. Signatures 120 are then further transported to conveyor 118. Alternatively, gripper arm transfer device 100 may be directly coupled to a folder of a printing press.

FIGS. 3 to 7D show the gripper arm transfer device 100 in more detail. Gripper arm transfer device 100 includes a pair of upper tapes 102 and a pair of lower tapes 104, a padded drum 106, a rotary arm 110, toothed drum 112 and an inserter or saddle chain 118. Rotary arm 110 includes four arms 111 each of which include a gripper 108.

Figure 7A:
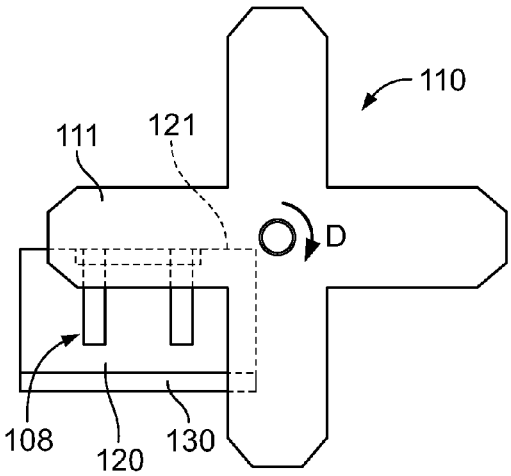
FIGS. 7A to 7D schematically show the gripper arm transfer device moving a signature in a plurality of positions.
Figure 7B:
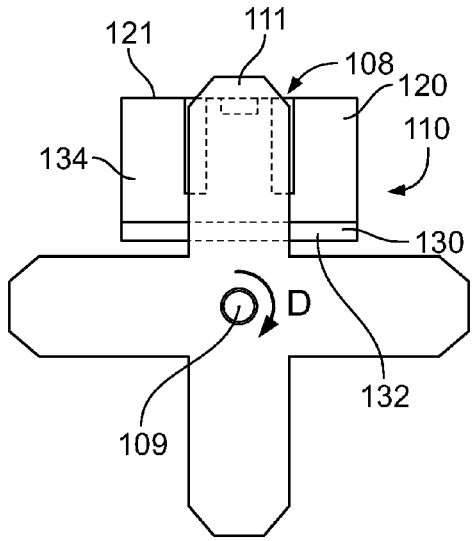

A folded signature 120 is fed to tapes 102, 104 via a sucker bar 218 (FIG. 2). Signatures 120 may be fed from a stack of signatures, for example, a stack collected by hopper 216 (FIG. 2). Each folded signature 120 includes a fold 121 and may be folded unevenly, so a lap 130 exists. Thus, folded signature 120 has a long leg 132, the longer side of the signature, and a short leg, 134, the shorter side of the signature. Signature 120 enters the tapes 102, 104 spine leading and travels in tapes 102, 104 to gripper 108 on rotary arm 110. Padded drum 106 assists in transfer of signature 120 from tapes 102, 104 to gripper 108. Each gripper 108 includes a plurality of brackets, guides and a finger 128. Gripper 108 receives signature 120 when an arm 111 is in a nine o'clock position as shown in FIG. 7A. At the area of receipt, signature 120 in tapes 102, 104 is moving at a speed slightly faster than a vertical velocity of gripper 108 on arm 111 so signature 120 registers in gripper 108.

Figure 7C:
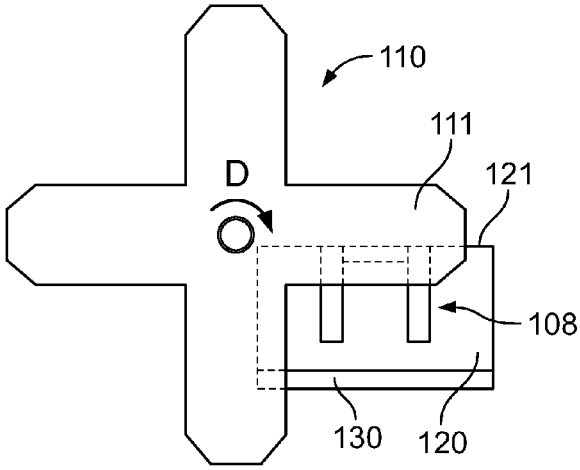
Figure 7D:
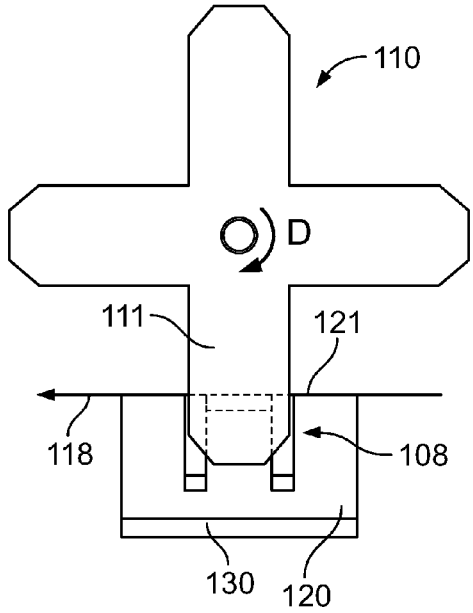

Gripper 108 can rotate with respect to rotary arm 110 and maintains signature 120 in an upright orientation parallel to chain 118 throughout the rotation of rotary arm 110 until signature 120 is deposited on chain 118 as shown in FIGS. 7A to 7D. Rotary arm 110 rotates in a clockwise direction D and moves arm 111 from the nine o'clock position shown in FIG. 7A to a twelve o'clock position shown in FIG. 7B. Signature 120 remains upright during the rotation. Rotary arm 110 rotates about a rotary axis 109. Preferably, rotary arm 110 rotates continuously. Thus, signature 120 is constantly being transported and does not need to be stopped during the transfer process. From the twelve o'clock position, rotary arm continues to rotate to a three o'clock position while gripper 108 continues to adjust in order to maintain signature 120 in an upright orientation as shown in FIG. 7C. Around the three o'clock position, the lap 130 of signature 120 strikes toothed drum 112 which forces signature 120 open. Teeth 122 on toothed drum 112 are cammed open so there is sufficient clearance for lap 130 to enter teeth 122. After lap 130 enters teeth 122, teeth 122 are cammed close on a long leg 132 of signature 120, however, teeth 122 do not grip signature lap 130 or short leg 134.

As rotary arm 110 continues to rotate, a body of signature 120 is traveling at a speed faster than long leg 132 in toothed drum 112 so long leg 132 stays in teeth 122 while short leg 134 is forced open. Once short leg 134 is forced open, finger 128 on gripper 108 is actuated up to go under short leg 134. Finger 128 ensures signature 120 stays open as signature 120 straddles chain 118.

Finally, rotary arm 110 rotates arm 111 and gripper 108 to a six o'clock position. At or near the six o'clock position, gripper 108 releases signature 120 onto conveyor 118. Once signature 120 straddles chain 118, finger 128 releases short leg 134. At this point, a horizontal velocity of signature 120 is near a velocity of chain 118. A plane of gripper 108 gripping signature 120 coincides with a plane of conveyor 118 which eases the transition of signature 120 from gripper 108 to conveyor 118 resulting in less damage to signature 120. Thus, in accordance with the present invention, signature 120 is not stopped during the transfer process and the velocity of signature 120 when signature 120 is placed on chain 118 is close to the velocity of the chain 118. Rotary arm 111 then returns to the nine o'clock position to grip a subsequent signature from tapes 102, 104.

In accordance with another preferred embodiment, gripper arm signature feeder 100 may be coupled directly to a folder and not use a sucker bar or rotor drum to singulate signatures. The folder would feed a stream of singulated signatures into a path of rotary arm as described above. The rotary arm 110 would then grip, open and transfer the signatures to a chain in the same manner as described above.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A signature transport device comprising:

a first conveyor moving a stream of folded signatures in a first direction;

a rotary arm having a gripper, the gripper gripping a folded signature from the stream by a fold, the rotary arm moving the folded signature in a second direction;

a toothed drum engaging a portion of the folded signature, the rotary arm rotating past the toothed drum to open the folded signature; and a second conveyor receiving the opened signature from the gripper as the rotary arm continues to rotate;

wherein the folded signature remains in an upright orientation while the gripper grips the folded signature.

2. The signature transport device as recited in claim 1 wherein the first conveyor includes tapes or belts.

3. The signature transport device as recited in claim 1 wherein the toothed drum includes teeth which are cam activated.

4. The signature transport device as recited in claim 1 wherein the rotary arm is continuously rotating so the signature is continuously moving from the stream to the conveyor.

5. The signature transport device as recited in claim 1 wherein the opened signature has a velocity at or near the velocity of the second conveyor when the signature is received on the second conveyor.

6. A saddle stitcher comprising:

a signature transport device in accordance with claim 1.

7. The signature transport device as recited in claim 1 wherein the gripper is rotatable with respect to the rotary arm.

8. A signature transport device comprising:

a first conveyor moving a stream of folded signatures in a first direction;

a rotary arm having a gripper, the gripper gripping a folded signature from the stream by a fold, the rotary arm moving the folded signature in a second direction;

a toothed drum engaging a portion of the folded signature, the rotary arm rotating past the toothed drum to open the folded signature; and a second conveyor receiving the opened signature from the gripper as the rotary arm continues to rotate, the gripper including a finger for holding the opened folded signature open.

9. A signature transport device comprising:

a hopper having a horizontal stack of folded signatures;

a first conveyor receiving the folded signatures from the hopper to form a stream of folded signatures moving in a first direction;

a rotary arm having a gripper, the gripper gripping a folded signature from the stream by a fold, the folded signature being in a plane of the gripper, the rotary arm rotating about an axis perpendicular to the gripper plane and moving the folded signature in a second direction while the signature remains in the gripper plane; and a second conveyor receiving the signature from the gripper as the rotary arm continues to rotate, a plane of the conveyor receiving the signature overlapping with the gripper plane when the signature is deposited on the conveyor.

10. The signature transport device as recited in claim 9 wherein the rotary arm includes four arms.

11. The signature transport device as recited in claim 10 wherein each arm includes a gripper.

12. The signature transport device as recited in claim 9 wherein the folded signature remains in an upright orientation while the gripper grips the folded signature.

13. The signature transport device as recited in claim 9 wherein the gripper is rotatable with respect to the rotary arm.

14. A method for transferring a signature to an inserter chain or saddle conveyor comprising the steps of:

removing printed products from a horizontal stack in a hopper;

moving a stream of folded printed products;

gripping a folded printed product by a fold using a rotary arm having a gripper;

opening the folded printed product while the folded printed product is gripped by the gripper on the rotary arm; and transferring the printed product to an inserter chain or saddle conveyor;

wherein the folded printed product remains in an upright orientation while the gripper grips the folded printed product.

15. The method for transferring a signature as recited in claim 14 wherein the step of moving a stream of folded printed products is performed by a conveyor.

16. A signature transport device comprising:

a first conveyor moving a stream of folded signatures in a first direction;

a rotary arm having a gripper, the rotary arm including four arms, the gripper gripping a folded signature from the stream by a fold, the rotary arm moving the folded signature in a second direction;

a toothed drum engaging a portion of the folded signature, the rotary arm rotating past the toothed drum to open the folded signature; and a second conveyor receiving the opened signature from the gripper as the rotary arm continues to rotate.

17. The signature transport device as recited in claim 16 wherein each arm includes a gripper.

* * * * *